United States Patent [19]

Robinson

[11] Patent Number: 4,561,273

[45] Date of Patent: Dec. 31, 1985

[54] DOORKNOB SECURITY APPARATUS

[76] Inventor: Forrest J. Robinson, P.O. Box 697, Mt. Vernon, Tex. 75457

[21] Appl. No.: 612,451

[22] Filed: May 21, 1984

[51] Int. Cl.[4] ..... E05B 17/14

[52] U.S. Cl. ..... 70/426; 70/209; 70/424

[58] Field of Search ..... 70/426, 425, 423, 424, 70/428, 427, 237, 209

[56] References Cited

U.S. PATENT DOCUMENTS

| | | |
|---|---|---|
| 1,439,552 | 12/1922 | Johnson . |
| 3,167,945 | 2/1965 | Goodman . |
| 3,245,240 | 4/1966 | De Forrest . |
| 3,340,709 | 9/1967 | Callahan . |
| 3,343,387 | 9/1967 | Cochran . |
| 3,623,346 | 11/1971 | Curtin . |
| 3,913,361 | 10/1975 | Fried . |
| 3,952,564 | 4/1976 | Maines . |
| 4,285,221 | 8/1981 | Atchisson . |

*Primary Examiner*—Robert L. Wolfe

*Attorney, Agent, or Firm*—Jerry W. Mills; Gregory M. Howison

[57] ABSTRACT

A doorknob security apparatus (10) includes an upper housing (14) and a lower housing (16) which cooperate to form a cylindrical member. Hinge parts (24) and (26) are disposed on one edge of the halves and a locking member (20) is disposed on the other side to secure the two halves together. A cover (18) is mounted in annular grooves (28) and (30) on the periphery of the two halves (14) and (16). Semi-annular rings (32) and (38) are disposed on the interior of the housings (14) and (16) to form spaces (34) and (40) while receiving the gripping portion of the doorknob. An orifice is formed with the semi-annular rings to fit about the stem of the doorknob with a diameter less than gripping portion of the doorknob to prevent removal of the apparatus (10) from the doorknob. Reinforcing portions (44) and (46) increase the structural integrity of the semi-annular members (32) and (38).

12 Claims, 5 Drawing Figures

DOORKNOB SECURITY APPARATUS

TECHNICAL FIELD OF THE INVENTION

The present invention pertains in general to security devices, and more particularly, to a security device for preventing access to the tumbler mechanism in an entry door lock.

BACKGROUND OF THE INVENTION

Security in motels and hotels and other such establishments is generally hindered by the lack of adequate locks and the inability to prevent access to the keys associated therewith. Although entry locks are placed on each door of the rooms in these establishments, the rapid turnover in clientele requires that the management constantly change the locks on these doors to insure adequate security. Even if this precaution is taken, there still exists the problem that a large number of support staff have access to all of the rooms with a master key. As a practical matter, the locks on these rooms are seldom changed and, if so, they are merely moved to adjacent rooms such that an individual having a key from a previous stay in one of the rooms can gain access to a room that is proximate to the one that he stayed in. The result is a distinct lack of security for an individual's possessions that are left behind in the room during the time that he is away from the room.

To provide security for a motel or hotel room while an occupant is away, a number of devices have been developed to cover the access lock. For example, U.S. Pat. No. 3,245,240 discloses a knob protection device which is comprised of two separate halves that conform to the shape of the doorknob. These two halves are hinged at one point and come together to form a covering for the doorknob. A lock on the other side secures the two halves together. However, a seam is formed down the middle of the doorknob which presents a disadvantage in that an intruder may pry between this seam to attain access to the key lock. Another device of this form is disclosed in U.S. Pat. No. 3,340,709, issued to H. A. Callahan. The Callahan device utilizes a cylindrical member closed at one end which fits over the doorknob. Two protrusions extend downward behind the backside of the doorknob to prevent removal thereof. A lock is utilized to cause reciprocation of the member behind the door lock for securing thereof. In addition to these patents, a number of other patents, have been issued on doorknob security devices. They are U.S. Pat. Nos. 1,439,552, 3,167,945, 3,245,240, 3,343,387, 3,623,346, 3,913,361, 3,952,564 and 4,285,221. Although all of the above devices utilize some form of covering for a doorknob to prevent access to the key lock, it is still possible to circumvent the security devices by inserting some foreign instrument into either the seam between two joining halves or behind the device itself.

In view of the above disadvantages, there exists a need for a security device that inhibits access to the key lock on the face of the doorknob and it is somewhat impervious to prying open with simple instruments.

SUMMARY OF THE INVENTION

The present invention disclosed and claimed herein comprises a security apparatus for inhibiting key access to a doorknob having a gripping portion with an integral lock and a stem portion for attachment to a door. The apparatus includes a first semi-cylindrical member and a second semi-cylindrical member. The first and second semi-cylindrical members cooperate to form a hollow right circular cylindrical member for disposal about the doorknob. The semi-cylindrical members are hinged on one side and have a lock disposed on the other side for securing the two halves together. A cover is provided over the distal end of the formed right circular cylinder to cover the integral lock and prevent access thereto. A restricting member is disposed interior to the two semi-cylindrical members and between the gripping portion of the knob and the door to prevent removal of the formed right circular cylindrical member from the doorknob. In this manner, removal of the security apparatus is facilitated only by separation of the first and second semi-cylindrical members. The cover is attached such that access to the peripheral edges thereof is impeded to prevent prying thereof by a foreign object.

In yet another embodiment of the present invention, an annular groove is formed on the periphery of each of the semi-cylindrical halves for receiving the cover, which is disk shaped. The grooves receive the peripheral edges of the disk shaped cover and, when the two semi-cylindrical halves are placed together, the cover protects the key face of the doorknob.

In a yet further embodiment of the present invention, the disk shaped cover is integrally molded with one of the semi-cylindrical halves and a groove formed on the peripheral edge of the other semi-cylindrical half. In this manner, assembly of the two halves results in the exposed periphery of the disk shaped cover fitting into the groove on the other half to prevent prying thereof.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
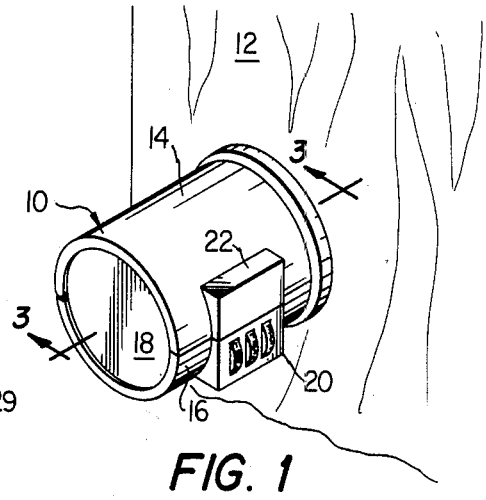
FIG. 1 illustrates a perspective view of the doorknob security apparatus in place on a doorknob.

Referring now to FIG. 1, there is illustrated a perspective view of a doorknob security apparatus 10 mounted in place on a doorknob (not shown) for opening a door 12. The security apparatus 10 is comprised of an upper half 14 and a lower half 16. The upper and lower halves 14 and 16 are semi-cylindrical in shape such that, when mounted together, they form a cylindrical housing. A cover 18 is disposed on the end of the housing formed by the upper and lower halves 14 and 16. The cover 18 is attached to the upper and lower halves 14 and 16 in a manner such that insertion of a foreign object between the upper and lower halves 14 and 16 and the peripheral edges of the cover 18 is prevented. This attachment will be described in more detail hereinbelow. A lock 20 is disposed on the lower half 16 and interacts with an interlocking mechanism 22. The operation of this locking mechanism will be described hereinbelow.

Figure 2:
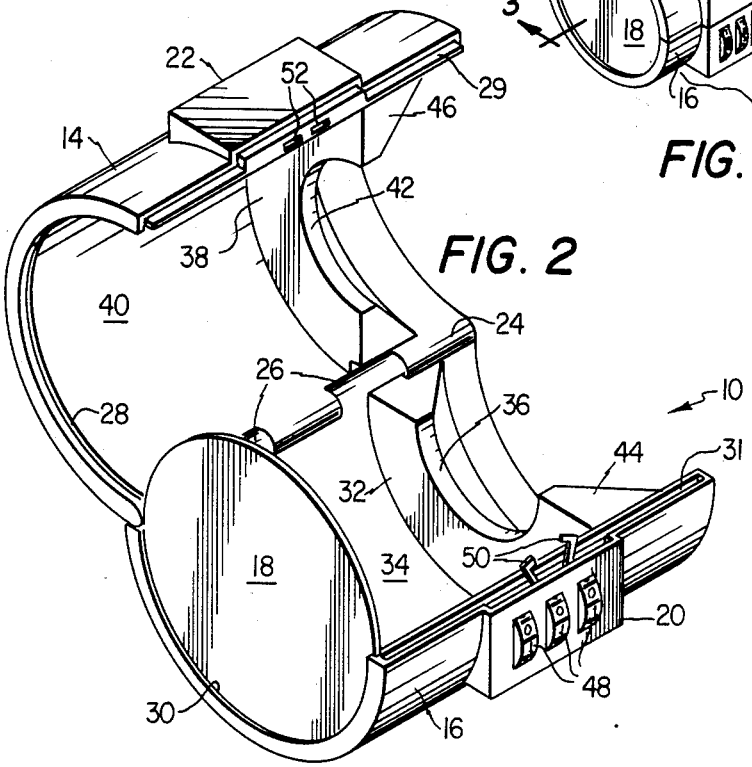
FIG. 2 illustrates a perspective view of the doorknob security apparatus in an open position.

Referring now to FIG. 2, there is illustrated a perspective view of the securing apparatus 10, shown opened up, wherein like numerals referred to like parts in the various figures. The upper half 14 has a hinge part 24 integrally formed on one of the longitudinal edges thereof. The lower half 16 has a mating hinge part 26 integrally formed on the other part thereof. The hinge part 24 and the mating hinge part 26 cooperate to form a hinge which, when the two halves 14 and 16 are joined together, conforms to the cylindrical profile of the overall housing. A pin (now shown) is inserted from the rearmost part of the apparatus 10 to form a rotational axis for the hinge.

The upper half 14 has an annular groove 28 formed in the periphery thereof. The lower half 16 has a similar annular groove 30 disposed in the periphery thereof. The grooves 28 and 30 are dimensioned to receive the disk shaped cover 18 when the two halves 14 and 16 are clamped together. By disposing the cover 18 in the grooves 28 and 30, movement of the peripheral edges of the cover 18 in the direction of the longitudinal axis of the apparatus 10 is prevented. In addition, the insertion of a foreign object around the peripheral edge of the cover 18 is prevented such that prying the cover 18 away from the upper and lower halves 14 and 16 is prevented.

In an alternate embodiment of the present invention, the cover 18 is integrally molded with the lower half 16 such that the groove 30 is not required. It is only necessary therefore to provide the groove 28 to coordinate with the exposed peripheral edge of the cover 18. This type of construction is well suited for injection molding of plastic material such as polyvinyl chloride (PVC).

By utilizing a solid cover over the doorknob, a seam does not exist proximate the key access, which is normally centrally located in the doorknob. In prevention of access through a seam proximate the keyhole, it is then necessary for a foreign object to be pressed up over the edge of the cover 18 and then downward to the centrally located keyhole. Since this is not possible, it will be necessary for an intruder to forcibly remove the cover 18 by insertion of a foreign object into one point on the periphery of the cover 18 and then prying the remaining portion away from the groove 28. As described above, this is difficult in that prying upward of one point on the periphery of the upper half 14 causes distortion thereof, resulting in increased force against the peripheral edges of the cover 18. The cover 18 is fabricated from the same material as the upper and lower halves 14 and 16 which, as described above, can be injection molded PVC. The thickness of the cover 18 is sufficient to prevent distortion thereof without actually cutting into the material Although this is possible with the proper tools, it would be difficult to cut into the material without arousing some attention from passersby.

A tongue 29 is disposed along the unhinged edge of the upper half 14 and a corresponding groove 31 is disposed on the lower half 16. When the two halves are brought together the tongue 29 and the groove cooperate to prevent movement along the radial direction. In addition, insertion of a foreign object into the security device past the tongue 29 and groove 31 is impeded.

A semi-annular ring 32 is disposed on the interior side of the lower half 16 and forms a space 34 between the semi-annular member 32 and the cover 18 for receiving the doorknob. The semi-annular ring 32 has an inner peripheral surface 36 which is dimensioned to fit about the stem of the doorknob. A semi-annular member 38, similar to the semi-annular member 32, is disposed on the interior surface of the upper half 14 and defines a space 40 for receiving the gripping portion of the doorknob. The semi-annular member 38 has an inner peripheral surface 42 for disposal adjacent the stem of the doorknob. When the upper and lower halves 14 and 16 are joined together, the inner peripheral surfaces 36 and 42 form an orifice which has a diameter that is smaller than the gripping portion of the doorknob but of sufficient diameter to circumvent the stem of most conventional doorknobs. By having a diameter smaller than the gripping portion, removal of the apparatus 10 is prevented unless the upper and lower halves 14 and 16 are separated.

The semi-annular member 32 has a reinforced portion 44 and the semi-annular member 36 has the reinforced portion 46. The reinforced portions 44 and 46 are formed by providing a taper to the thickness of the semi-annular members 32 and 38 that decreases in thickness as the radius decreases. The reinforcing portions 44 and 46 provide resistance to forces directed outward from the door 12 along the longitudinal axis of the securing apparatus 10. In this manner, the doorknob itself cannot be used as a lever to enlarge the orifice formed by the inner peripheral surfaces 36 and 42.

The lock portion 20, in the preferred embodiment, is fabricated from a combination lock which has three tumblers 48. Although not shown, the combination lock is programmable such that each individual can choose his own combination. The lock 20 has a pair of interlocking clasps 50 that interact with the interlocking mechanism 22 on the upper half 14. The clasps 50 are insertable into two orifices 52 for securing therewith. When the combination is dialed on the tumblers 48, the clasps 50 rotate outwards to allow removal from the orifices 52. However, when the tumblers 48 are positioned at other than the correct combination, the clasps 50 rotate inward to prevent removal from the orifice 52, thus securing the two halves together.

Figure 3:
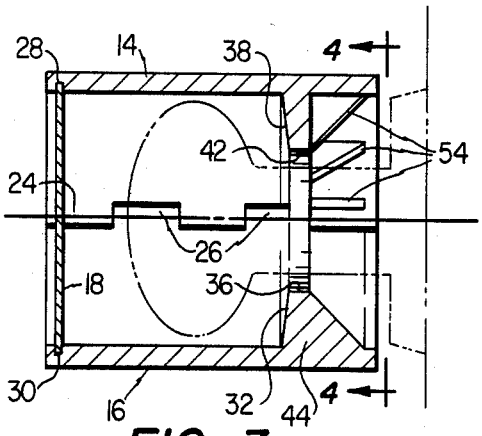
FIG. 3 illustrates a cross-sectional view taken along lines 3—3 of FIG. 1.
Figure 4:
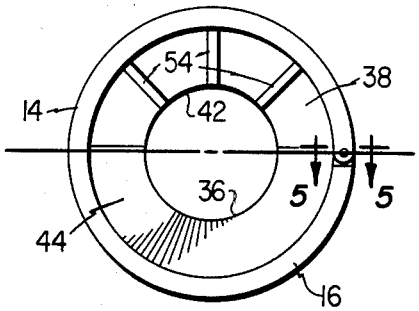
FIG. 4 illustrates an end view of the doorknob security apparatus of FIG. 3 taken along lines 4—4.

Referring now to FIG. 3, there is illustrated a cross-sectional view of the apparatus 10 of FIG. 1 taken along line 3—3 of FIG. 1 and also referring to FIG. 4, which illustrates an end view of the apparatus of FIG. 3 taken along lines 4—4. Like numerals refer to like parts of the various FIGURES. The view of FIGS. 3 and 4 illustrate two embodiments of the reinforcing method utilized for the semi-annular members 32 and 38. In the lower portion of the FIGURES, the reinforcing portion 44 with the taper structure is illustrated. In the upper portion of the FIGURES, a plurality of outwardly tapering ribs 54 are disposed against the rear surface of the semi-annular member 38. By utilizing the ribs 54, structural integrity is maintained while utilizing less material. This results in lighter weight and decreased costs.

Figure 5:
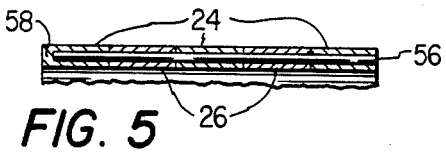
FIG. 5 illustrates a cross-sectional view of the hinge member taken along lines 5—5 of FIG. 4.

Referring now to FIG. 5, there is illustrated a cross-sectional diagram of the hinge mechanism taken along lines 5—5 of FIG. 4, wherein like numerals refer to like parts in the various FIGURES. A pin 56 is disposed through the center of the hinge parts 24 and 26 with the end thereof separated from the distal end of the hinge members 24 by a portion 58. The portion 58 is a "blind end" which prevents access of the pin 56 from the front of the apparatus 10. To assemble the device, the pin 56 is pressed in from the rear of the apparatus 10. Once the apparatus 10 is placed about a doorknob, it is virtually impossible to move pin 56 since it is disposed against the door 12. By inhibiting access to the pin from the front, it is necessary to destroy a portion of the upper and lower halves 14 and 16 to gain access to the pin 56. In addition, the pin 56 can be fabricated from hardened steel which prevents cutting therethrough.

In summary, there has been provided a doorknob security apparatus which includes upper and lower semi-cylindrical housings which are hinged together at one point. On the other side of the housing halves, a locking mechanism is provided to secure the two halves together to form a cylindrical housing. The open end of the cylindrical housing is covered with a disk shaped member that is mounted in two annular grooves in the peripheral of the housing halves. By utilizing the grooves, removal of the disk shaped cover is prevented. A pair of semi-annular rings are disposed interior to the cylindrical housing to fit about the stem of the doorknob and form an orifice that is smaller than the gripping portion of the doorknob. The semi-annular rings prevent removal of the security apparatus without separation of the two halves.

Although the preferred embodiment has been described in detail, it should be understood that various changes, substitutions, and alterations can be made therein without departing from the spirit and scope of the invention as defined by the claims.

What is claimed is:

1. A security apparatus for inhibiting key access to a doorknob having a gripping portion with an integral lock and a stem portion, comprising:

a first semi-cylindrical member;

a second semi-cylindrical member, said first and second semi-cylindrical members cooperating to form a hollow right circular cylinder for disposal about the doorknob;

locking means for locking said first and second semi-cylindrical members together about the doorknob;

a disk shaped member dimensioned to cover the open end of said formed right circular cylinder;

a first arcuate grove disposed along the periphery of said first semi-cylindrical member and directed radially inward, said first groove for receiving one-half of the periphery of said disk shaped member;

a second groove disposed on periphery of said second semi-cylindrical member and directed radially inward, said second groove for receiving the periphery of the remaining half of said disk shaped member;

said first and second grooves securing said disk shaped member to the periphery of said formed right circular cylinder until said first and second semi-cylindrical members are separated;

said disk shaped member providing a sealed surface over the integral lock to prevent access thereto; and restricting means attached to the interior of said formed right circular cylinder about the stem of the doorknob for preventing removal of said formed right circular cylinder, removal of the security apparatus facilitated only by the separation of said first and second semi-cylindrical members.

2. The apparatus of claim 1 wherein said locking means comprises:

a hinge attached between one side of each of said first and second semi-cylindrical members; and a lock having a tumbler section attached to the remaining side of said first semi-cylindrical member and an interlocking section connected to the remaining side of said second semi-cylindrical member, said tumbler section and said interlocking section cooperating to secure the two corresponding edges together.

3. A security apparatus for inhibiting key access to a doorknob having a gripping portion with an integral lock and a stem portion, comprising:

a first semi-cylindrical member;

a second semi-cylindrical member, said first and second semi-cylindrical members cooperating to form a hollow right circular cylinder for disposal about the doorknob;

locking means for locking said first and second semi-cylindrical members together about the doorknob;

a disk shaped member dimensioned to cover the open end of said formed right circular cylinder;

said disk shaped member having one-half of the periphery thereof integrally molded with the arcuate periphery of said first semi-cylindrical member and disposed perpendicular to the longitudinal axis thereof;

an arcuate groove disposed along the arcuate periphery of said second semi-cylindrical member and directed radially inward, said groove for receiving the remaining half of the periphery of said disk shaped member such that access to the integral lock of the doorknob is prevented unless said first and second semi-cylindrical members are separated;

said disk shaped member providing a sealed surface over the integral lock to prevent access thereto; and restricting means attached to the interior of said formed right circular cylinder about the stem of the doorknob for preventing removal of said formed right circular cylinder, removal of the security apparatus facilitated only by the separation of said first and second semi-cylindrical members.

4. The apparatus of claim 1 wherein said restricting means comprises:

a first semi-annular member disposed on the interior of said first semi-cylindrical member diametrically opposite said cover means; and a second semi-annular member disposed on the interior surface of said second semi-cylindrical member;

said first and second semi-annular members cooperating to encompass the stem of the doorknob when said first and second semi-cylindrical members are secured together, the portion of said first and second semi-annular members that encompass the stem of the doorknob defining an orifice that is smaller than the gripping portion of the doorknob such that the securing apparatus cannot be removed without separating said first and second semi-cylindrical members.

5. The apparatus of claim 4 and further comprising reinforcing means for reinforcing said first and second semi-annular members against forces directed along the longitudinal axis of said formed right circular cylinder away from said cover means such that attempted removal of the securing apparatus without separating the first and second semi-cylindrical members result in reinforced resistance.

6. A security apparatus for inhibiting key access to a doorknob having a gripping portion with an integral lock and a stem portion for attachment to a door, comprising:

a right circular cylinder housing for being disposed over the doorknob, said housing having:
a first semi-cylindrical half; and
a second semi-cylindrical half;

a hinge for attaching one side of each of said first and second semi-cylindrical halves together;

a lock for securing the remaining sides of each of said first and second semi-cylindrical halves together;

a circular cover dimensioned to cover the end of said right circular cylinder housing;

a first annular groove disposed on the periphery of said first semi-cylindrical half and directed radially inward, said first annular groove for receiving one-half of the periphery of said circular cover;

a second annular groove disposed on the periphery of said second semi-cylindrical half and directed radially inward, said second annular groove for receiving the remaining half of said circular cover;

said first and second annular grooves preventing access to the edge of said circular cover by a foreign device such that prying of the edge of said circular cover away from said housing is prevented;

a first semi-annular member disposed on the interior of said first semi-cylindrical half; and a second semi-annular member disposed on the interior of said second semi-cylindrical half;

said first and second semi-annular members cooperating to provide a restricted orifice about the stem of the doorknob that will not pass over the gripping portion such that the security apparatus cannot be removed without separation of said first and second semi-cylindrical halves.

7. The apparatus of claim 6 and further comprising reinforcing means for reinforcing said first and second semi-annular members against forces directed along the longitudinal axis of said housing away from said circular cover as a result of forcibly trying to remove the securing apparatus without separation of the first and second semi-cylindrical halves.

8. The apparatus of claim 7 wherein said reinforcing means comprises a plurality of ribs disposed between the surface of said first and second semi-annular members and the inner surface of said first and second semi-cylindrical halves on the opposite side of said semi-annular members from said circular cover.

9. The apparatus of claim 6 wherein said lock comprises a combination lock.

10. The apparatus of claim 6 wherein said hinge is not accessible from the exterior of said housing to prevent separation thereof.

11. A security apparatus for inhibiting key access to a doorknob having a gripping portion with an integral lock and a stem portion for attachment to a door, comprising:

a right circular cylinder housing for being disposed over the doorknob, said housing having:
a first semi-cylindrical half; and
a second semi-cylindrical half;

a hinge for attaching one side of each of said first and second semi-cylindrical halves together;

a lock for securing the remaining sides of each of said first and second semi-cylindrical halves together;

a circular cover dimensioned to cover the end of said right circular cylinder housing;

said circular cover being integrally molded with said first semi-cylindrical half such that the surface thereof is perpendicular to the longitudinal axis of said right circular cylindrical housing;

an annular groove disposed about the periphery of said second semi-cylindrical half, said annular groove for receiving the remaining periphery of said circular cover such that insertion of a foreign instrument about the edge of said circular cover is impeded;

a first semi-annular member disposed on the interior of said first semi-cylindrical half; and a second semi-annular member disposed on the interior of said second semi-cylindrical half;

said first and second semi-annular members cooperating to provide a restricted orifice about the stem of the doorknob that will not pass over the gripping portion such that the security apparatus cannot be removed without separation of said first and second semi-cylindrical halves.

12. The apparatus of claim 6 and further comprising a tongue formed on the edge of said first semi-cylindrical half opposite said hinge and a groove formed on the edge of said second semi-cylindrical half, said tongue and groove cooperating to prevent movement in a radial direction and to prevent insertion of foreign objects into the security apparatus.

* * * * *